US007152276B2

(12) United States Patent
Jin et al.

(10) Patent No.: US 7,152,276 B2
(45) Date of Patent: Dec. 26, 2006

(54) FILTER ASSEMBLY FOR A CYCLONE-TYPE DUST COLLECTING APPARATUS OF VACUUM CLEANER

(75) Inventors: Hyoung-Jong Jin, Gwangju (KR); Jang-Keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 387 days.

(21) Appl. No.: 10/620,736

(22) Filed: Jul. 16, 2003

(65) Prior Publication Data

US 2004/0200029 A1 Oct. 14, 2004

(30) Foreign Application Priority Data

Apr. 14, 2003 (KR) ..... 10-2003-0023436

(51) Int. Cl.
*A47L 9/20* (2006.01)
*A47L 9/16* (2006.01)

(52) U.S. Cl. ..... 15/352; 15/353; 55/295

(58) Field of Classification Search ..... 15/347, 15/350–353; 55/295–298, 337, DIG. 3
See application file for complete search history.

(56) References Cited

U.S. PATENT DOCUMENTS

| | | | | |
|---|---|---|---|---|
| 2,171,248 | A * | 8/1939 | Van Berkel | 55/392 |
| 2,187,546 | A * | 1/1940 | Strattner | 55/288 |
| 2,484,491 | A * | 10/1949 | Daugherty | 55/290 |
| 2,594,456 | A * | 4/1952 | Kroenlein | 55/296 |
| 2,639,780 | A * | 5/1953 | Hardy | 55/296 |
| 2,976,558 | A * | 3/1961 | Fain | 15/312.1 |
| 3,568,414 | A * | 3/1971 | Spriggs et al. | 55/294 |
| 4,314,409 | A * | 2/1982 | Cartier et al. | 34/82 |
| 4,557,738 | A | 12/1985 | Menasian | 55/288 |
| 4,710,207 | A * | 12/1987 | Bodovsky et al. | 55/290 |
| 5,271,751 | A * | 12/1993 | Lagler | 55/295 |
| 5,603,740 | A * | 2/1997 | Roy | 55/283 |
| 6,625,845 | B1 * | 9/2003 | Matsumoto et al. | 15/353 |
| 2002/0124729 | A1 * | 9/2002 | Dudley | 95/282 |
| 2004/0187253 | A1 * | 9/2004 | Jin et al. | 15/352 |

FOREIGN PATENT DOCUMENTS

| | | |
|---|---|---|
| GB | 0682137 A | 11/1952 |
| GB | 2388307 A | 11/2003 |
| JP | 2003-038398 | 2/2003 |
| JP | 2002-315701 | 10/2004 |

OTHER PUBLICATIONS

European Search Report Application No. GB 0317872.0, dated Dec. 22, 2003.
State of the Art issued Feb. 17, 2006 from the Spanish Patent Office with respect to Spanish Patent Application No. 200302349 filed Oct. 9, 2003.

* cited by examiner

*Primary Examiner*—Terrence R. Till
(74) *Attorney, Agent, or Firm*—Ohlandt, Greeley, Ruggiero & Perle, L.L.P.

(57) ABSTRACT

A filter assembly for a cyclone-type dust collecting apparatus of a vacuum cleaner which filters dust included in the air current discharged from the outlet port of the cyclone-type dust collecting apparatus. The present filter assembly comprises a rotating filter rotatively coupled against the outlet port and an inlet grill; an operation bar; and a handling knob. The dust collected on the outer surface of the rotating filter may be removed by rotating the rotating filter with the handling knob and thus improves dust-collecting efficiency.

8 Claims, 7 Drawing Sheets

FILTER ASSEMBLY FOR A CYCLONE-TYPE DUST COLLECTING APPARATUS OF VACUUM CLEANER

BACKGROUND OF THE INVENTION

1. Field of the Invention

The present invention relates to a cyclone-type dust collecting apparatus, and in particular to a filter assembly installed inside the cyclone-type dust collecting apparatus for filtering dust that has gone through centrifugal separation then discharging the same.

2. Description of the Related Art

The filter which is installed inside the cyclone-type dust collecting apparatus of a vacuum cleaner functions to filter the minute dust within air that is discharged into the cleaner main body. Generally, the dust filtered progressively collect on these filters and thus causes the inconvenience of periodic cleaning. Therefore, recently a filter cleaning device which works in connection with the opening and closing of a dust collecting container of a cyclone-type dust collecting apparatus for removing dust on the outer surface of the filter has been suggested.

FIG. 1 is a longitudinal view of a cyclone-type dust collecting apparatus installed with a conventional filter cleaning device, and FIG. 2 is a perspective view of the filter cleaning device of which was disclosed in the Japanese patent application no. 2002-315701. The cyclone-type dust collecting apparatus 1, as depicted in FIG. 1, is provided with a cyclone body 110 formed with an inlet port 111 and an outlet port 121, a dust collection container 103 removably coupled to the cyclone body 110, and a filter 130 which is installed on the outlet port 121 of the cyclone body 110 and arranged within the dust collection container 103.

The cyclone body 110 is provided with a container coupling 125 which forms the dust separation chamber 115, and a connection pipe 113 which is extended from the dust separation chamber 115 in an elbow form. In the dust separation chamber 115, an inlet port 111 opened outward in an oblique direction, and an outlet port 121 opened upward are provided. The inlet port 111 is in fluid communication with the interior of the connection pipe 113, and an inlet pipe 107 which has a dust inlet not shown of the vacuum cleaner is connected on the end of the connection pipe 113. On the outlet pipe 121, a flexible pipe 109 which is connected to the cleaner main body of the vacuum cleaner is coupled.

The container coupling 125 of the cyclone body 110 is opened downward and receives the cylinder-shaped dust collection container 103 which has an upward opening. A gasket 141 intervenes the outer surfaces of the openings between the container coupling 125 of the dust collection chamber 115 and the dust collection container 103 to maintain air-tightness. Meanwhile, the dust collection container 103 is provided with a hook 104 protruding from the bottom outer surface thereof to the connection pipe 113 of the cyclone body 11. On the outer surface of the connection pipe 113 which corresponds to the hook 104 there is formed a hook groove 114 and thus the hook 104 is able to be clamp-fastened into the hook groove 114 in the vertical direction.

As such, within the dust collection container 103 coupled on to the bottom of the dust collection chamber 115, a filter 130 which is connected to the outlet port 121 of the dust collection chamber 115 is accommodated. The filter 130 is cylindrical-shaped and opened upward, and a plurality of ventilation shafts is formed on the outer circumference. Also, on the outer surface of the ventilation shafts, a net 135 having numerous micro ventilation pores is installed. This net 135 functions to filter the minute dust included in the exhausted air.

Meanwhile, the conventional filter cleaning device 150 mounted on the cyclone-type dust collecting apparatus, as depicted in FIG. 2, is provided with a dust removal ring 151 which surrounds the outer surface of the filter 130, an elastic spring 155 elastically biasing the dust removal ring 151 downward, and a slider 161 and locking lever 171 which fastens the dust removal ring 155 on to the top of the filter 130. Between the connection pipe 113 of the cyclone body 110 and the dust collection container 103 a guide groove 157 is formed for the vertical sliding of the slider 161.

The slider 161 is extended bent downward from the outer surface of the dust removal ring 151, and is slide-ably received in the guide groove 157 in the vertical direction. This slider 161 is provided with a coupling protrusion 162 which is coupled to a protrusion groove, not shown, of the dust collection container 103, and through the activation of the coupling protrusion 162 and the protrusion groove, the dust collection container 103 is slide-able as a whole unit with the slider 161. Namely, by moving in conjunction with the sliding of the slider 161, the dust collection container 103 is removably coupled to the dust collection chamber 115. Also on the slider 161, on a longitudinal extension on one side thereof, a couple of locking grooves 165, 166 are engraved at an equal spacing.

Meanwhile, the locking lever 171 is provided with a locker 172 which functions with the locking grooves 165, 166 of the slider 161, and an operation section 174 which is operational by the user. This locking lever 171 rotates about a rotation shaft 176 installed in the guide groove 157 and couples the locker 172 to the locking grooves 165, 166 of the slider 161. For this, on the outside of the locking lever 171, a locker spring 181 which elastically biases the locker 172 to the locking grooves 165, 166 is installed.

Through the above configuration, in the cyclone-type dust collecting apparatus 100 provided with the conventional filter cleaning device 150, the dust collection container 103 may be separated by depressing the operation section 174. Then, the filter cleaning device 150 operates in conjunction with the separated dust collection container 103. Namely, when the locker lever 171 is rotated about the rotation shaft 176 by pressing the operation section 174 of the locking lever 171, the locker 172 is outwardly separated from the locker grooves 165, 166 of the slider 161. Here, the compressed elastic spring 155 possessing elastic force expands and separates the dust collection container 103 and at the same time, the dust removal ring 151 and the slider 161 slide downward.

Here, the downwardly moving dust removal ring 151 slides while sweeping the collected dust on the outer surface of the filter 130 and thereby the swept dust falls into the dust collection container 103 and is recollected. Then, the user releases the interlocking of the protrusion groove of the dust collection container 103 and the coupling protrusion 162 of the slider 161, and then may remove the waste and dust collected within the dust collection container 103. Meanwhile, the dust collection container 103 with the waste and dust removed, may be coupled to the container coupling 125 of the cyclone body 110 by biasing upwardly in the inverse order of the above description.

However, in the filter cleaning device 150 of the conventional cyclone-type dust collecting apparatus 100, in case the amount of filtered dust on the outside of the filter 130 is excessive, there is the problem of the movement of the dust removal ring 151 being interrupted and thus the function thereof being depreciated. In this case, there is the inconvenience of the user having to remove the filtered dust on the outside of the filter 130 by hand and then cleaning the filter for the dust removal ring 151 to move smoothly.

Also in the filter cleaning device 150 of the conventional cyclone-type dust collecting apparatus 100 there is the complicated composition for elevating the dust removal ring 151 to the outer surface of the filter 130, namely the slider 161, locking lever 171 and the locker spring 181 must necessarily be provided and thus there is the problem of increase in manufacturing costs and causing difficulty in assembling and disassembling. In the filter cleaning device 150 of the conventional cyclone-type dust collecting apparatus 100, the guiding groove 157 for the vertical sliding of the slider 161 must be formed between the connection pipe 113 of the cyclone body 110 and the dust collection container 103 and thus causes more increase in cost from having to manufacture an expensive mold with complex geometries.

SUMMARY OF THE INVENTION

The present invention has been set forth in consideration of the above mentioned problems, where the object thereof is to provide a filter assembly for a cyclone-type dust collecting apparatus of a vacuum cleaner in which the filter may be rotated to simply remove the dust collected thereon.

Another object of the present invention is to provide a filter assembly for a cyclone-type dust collecting apparatus having a dust collection container of a vacuum cleaner which not only saves manufacturing cost through by providing a simple composition but also of which is easily assembled and disassembled.

Another object of the present invention is to provide a filter assembly which does not require a guide groove between the dust collection container and the connection pipe of the cyclone body and thereby enable the manufacturing of the cyclone-type dust collecting apparatus of a vacuum cleaner with a simple mold.

To achieve the above objects, according to the present invention, in a filter assembly for a cyclone-type dust collecting apparatus having a dust collection container of a vacuum cleaner which filters the dust included in the air current discharged on the outlet port of the cyclone-type dust collecting apparatus comprising a rotating filter rotatively coupled against said outlet port and provided with an inlet grill formed on the outer surface and an outlet in communication with said outlet port; an operation bar arranged in an axial direction within said dust collection container and provided with one end coupled to said rotating filter and with another end passing through said dust collection container and exposed to the outside; and a handle knob coupled to said another end of said operation bar enabling said operation bar to be rotated wholly with said rotating filter.

BRIEF DESCRIPTION OF THE DRAWINGS

The objects and characteristics of the present invention will be described in detail in conjunction with the preferred embodiments thereof and with reference to the attached drawings.

DETAILED DESCRIPTION OF THE PREFERRED EMBODIMENT

The present invention is described in detail hereinafter with reference to the attached drawings.

Figure 3:
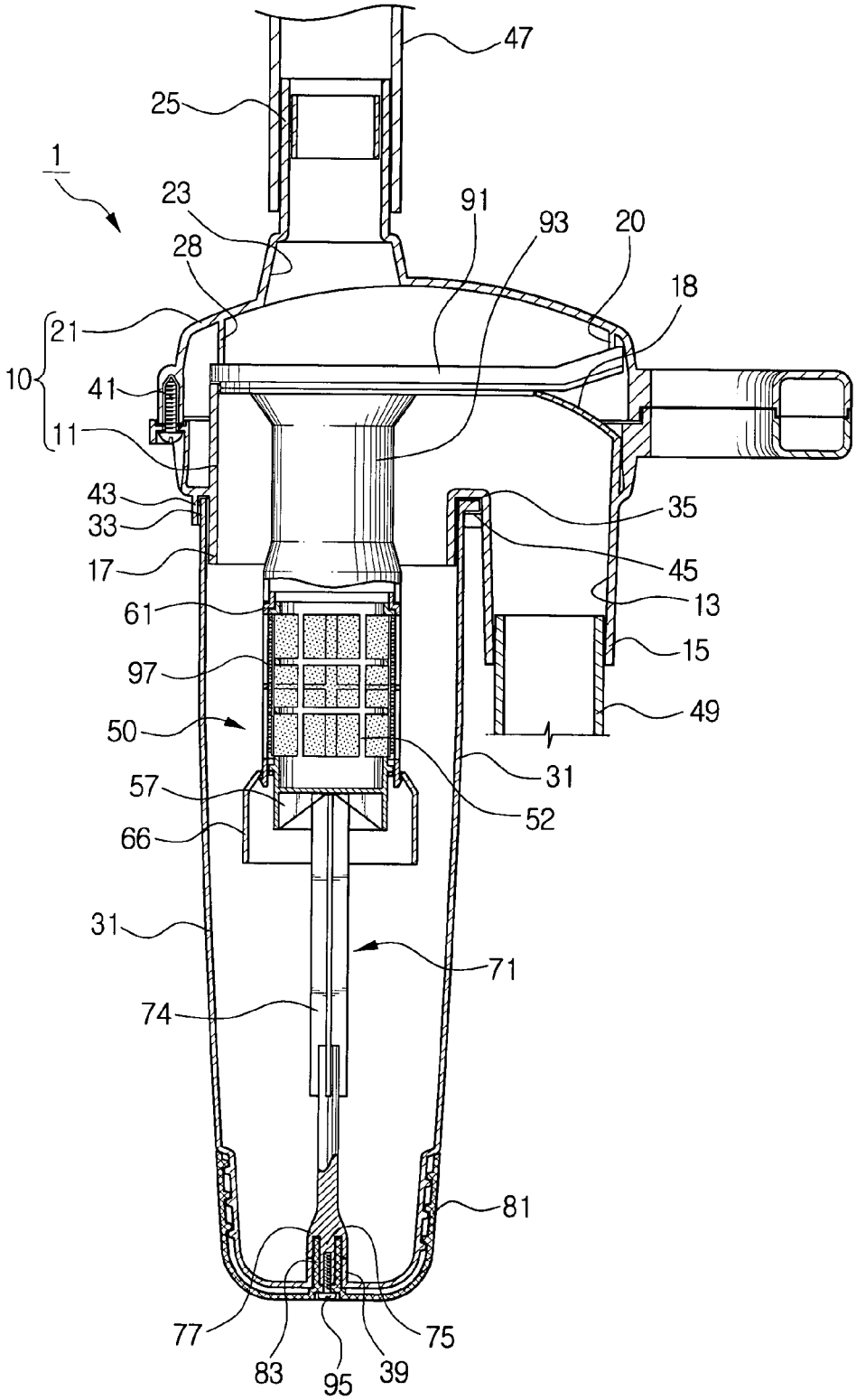
FIG. 3 is a longitudinal cross-sectional view of the filter assembly for the cyclone-type dust collecting apparatus of a vacuum cleaner according to the present invention.

FIG. 3 is a longitudinal cross-sectional view of the cyclone-type dust collecting apparatus of a vacuum cleaner provided with a filter assembly. As depicted in FIG. 3, the cyclone-type dust collecting apparatus 1 mounted with the present filter assembly 50 is provided with a cyclone body 10 with an inlet port 13 and an outlet port 23 formed thereon, a dust collection container 31 removably coupled to the cyclone body 10, and a filter assembly 50 installed on the outlet port 23 of the cyclone body 10 and arranged within the dust collection container 31.

The cyclone body 10 is formed of an upper body 21 where the outlet port 23 is formed and a lower body 11 where the inlet port 13 is formed, and these upper and lower bodies 21,11 are coupled by a plurality of screws. On the outlet port 23 opened upwardly from the upper body 21 there is extended upwardly an outlet side coupling pipe 25. This outlet side coupling pipe 25 is coupled to a flexible connection pipe 47 which is connected to the cleaner main body not shown of the vacuum cleaner.

The lower body 11 is provided with a downwardly opening inlet port 13, and a container coupling 17 opening downwardly parallel with the inlet port 13. On the inlet port 13 and inlet side coupling pipe 15 extends in the downward direction. This inlet side coupling pipe 15 is coupled with an inlet pipe 49 having a dust induction portion not shown of the vacuum cleaner. In addition, on the outer surface of the container coupling 17 there is formed a coupling rib 43 which receives the coupling extension of the dust collection container 31. On the coup ling rib 43 there is provided a coupling slit 45 cut in the horizontal direction.

Between the upper body 21 and the lower body 11 of the cyclone body 10, there intervenes a waste backflow prevention plate 91. The waste backflow prevention plate 91 is a plate having a conical shape and divides the interior space formed by the upper body 21 and the lower body 11. On the upper and lower bodies 21,11 of the cyclone body 10 there are protruding waste backflow prevention fastening ribs 18,28, respectively. On the waste backflow prevention plate 91 there is formed an outlet hole not shown which allows air current to flow from the lower body 11 to the upper body 21. Also, on the opening of the outlet hole, there is an extended container-shaped coupling flange 93 protruding downward. On the coupling flange 93, as will be described in detail hereinafter, the filter assembly 50 is removably coupled.

Figure 1:
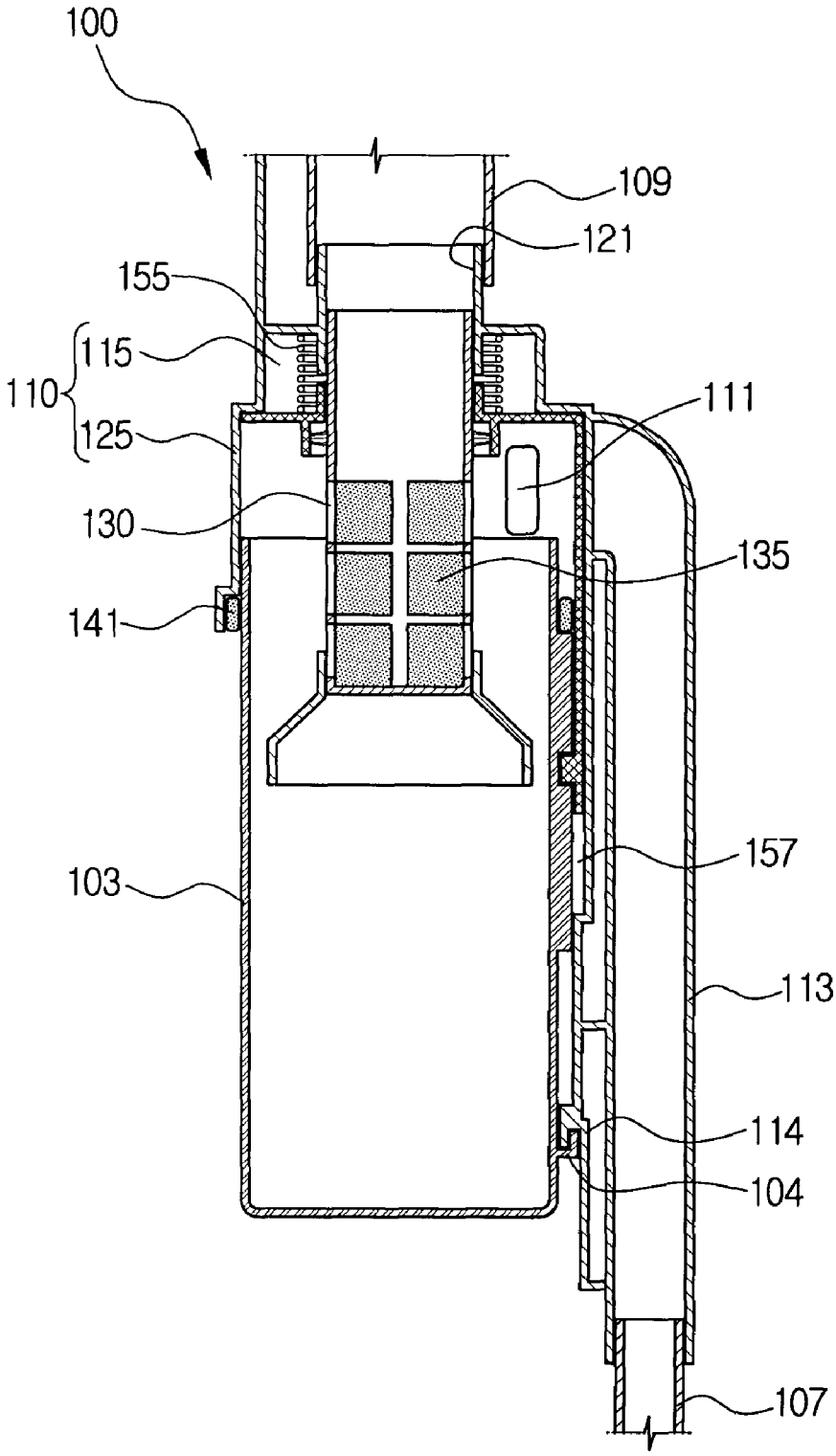
FIG. 1 (PRIOR ART)
FIG. 1 is a longitudinal cross-sectional view of the cyclone-type dust collecting apparatus of a vacuum cleaner installed with a conventional filter cleaning device.
Figure 2:
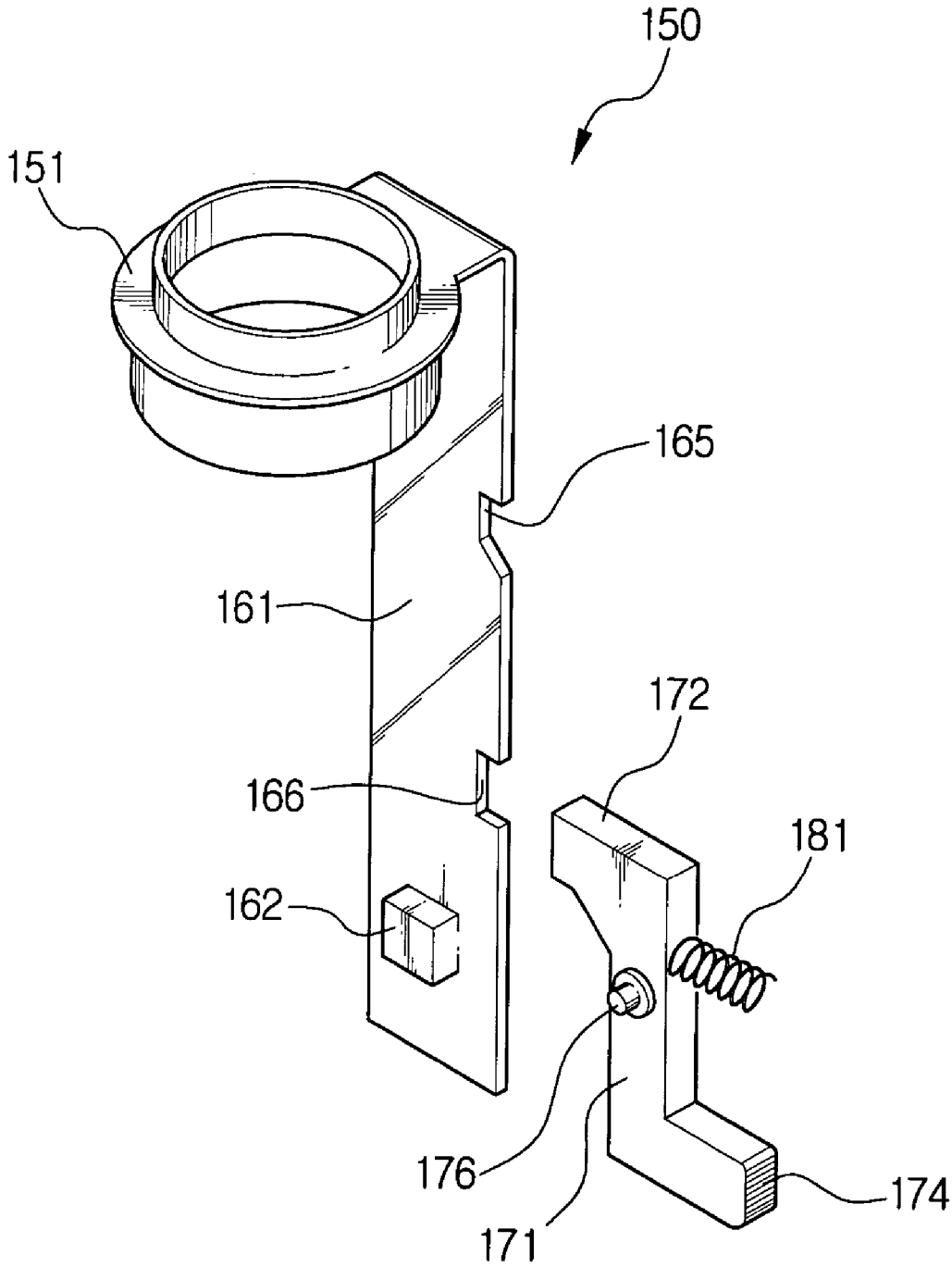
FIG. 2 (PRIOR ART)
FIG. 2 is a partially enlarged perspective view of the FIG. 1 where the conventional filter cleaning device is shown in detail.

Differing from the conventional dust collection container 103, FIG. 1, the dust collection container 31 is cylinder-shaped opening upward which has a simple structure without the slider guiding groove 157, FIG. 1 and protrusion groove. The dust collection container 31 opening extension forms the coupling extension 33 which is received into the coupling rib 43, and on this coupling extension 33 a locking protrusion 35 which interlocks with the coupling slit 45 is protruded. With the dust collection container 31 coupling extension 33 received in the container coupling 17 coupling rib 43, when rotated to one direction, the locking protrusion 35 is received into the coupling slit 45. Through this, the dust collection container 31 is removably coupled to the cyclone body 10.

Figure 4:
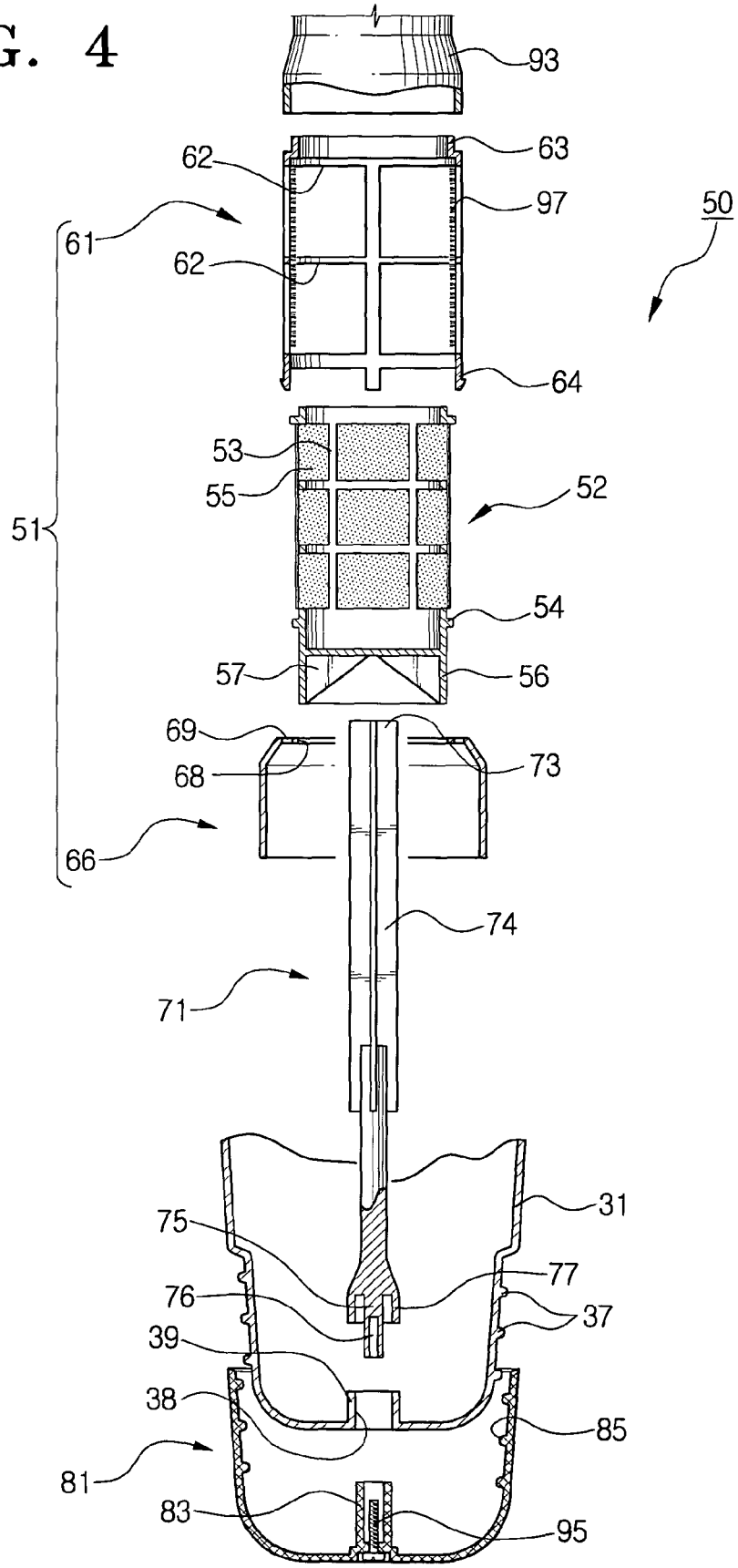
FIG. 4 is an exploded view of the main components of FIG. 3, where the composition of the present filter assembly is shown in detail.

In addition, on the dust collection container 31, a bar passing hole 38, FIG. 4 for passing through the bottom end of the operation bar 71 is formed on the bottom surface. On the bottom surface of the dust collection container 31, there is formed a rotation support rib 39 protruding upward from the opening rim of the bar passing hole 38. This rotation support rib 39 functions to rotatively support the operation bar 71. Also, on the bottom outer surface of the dust collection container 31 there are formed three outwardly protruding guide protrusions 37 along the circumferential direction. These guide protrusions 37 guide the smooth rotation of the handling knob 81.

Meanwhile, FIG. 4 is an exploded view of the major portions of FIG. 3, where the composition of the present filter assembly is shown in more detail. As depicted in FIG. 4, the filter assembly 50 is provided with a rotating filter 52 rotational against the outlet port 23 formed on the upper body 21 of the cyclone body 10, a handling knob 81 arranged on the lower portion of the dust collection container 31, and an operation bar 71 intervening between the handling knob 81 and the rotating filter 53. Here, it is preferable that the rotating filter 53 is rotatively supported within the rotation support body 51. Also, on the outer surface of the rotating filter 53 brushes 97 for removing filtered dust may be further included.

Figure 5:
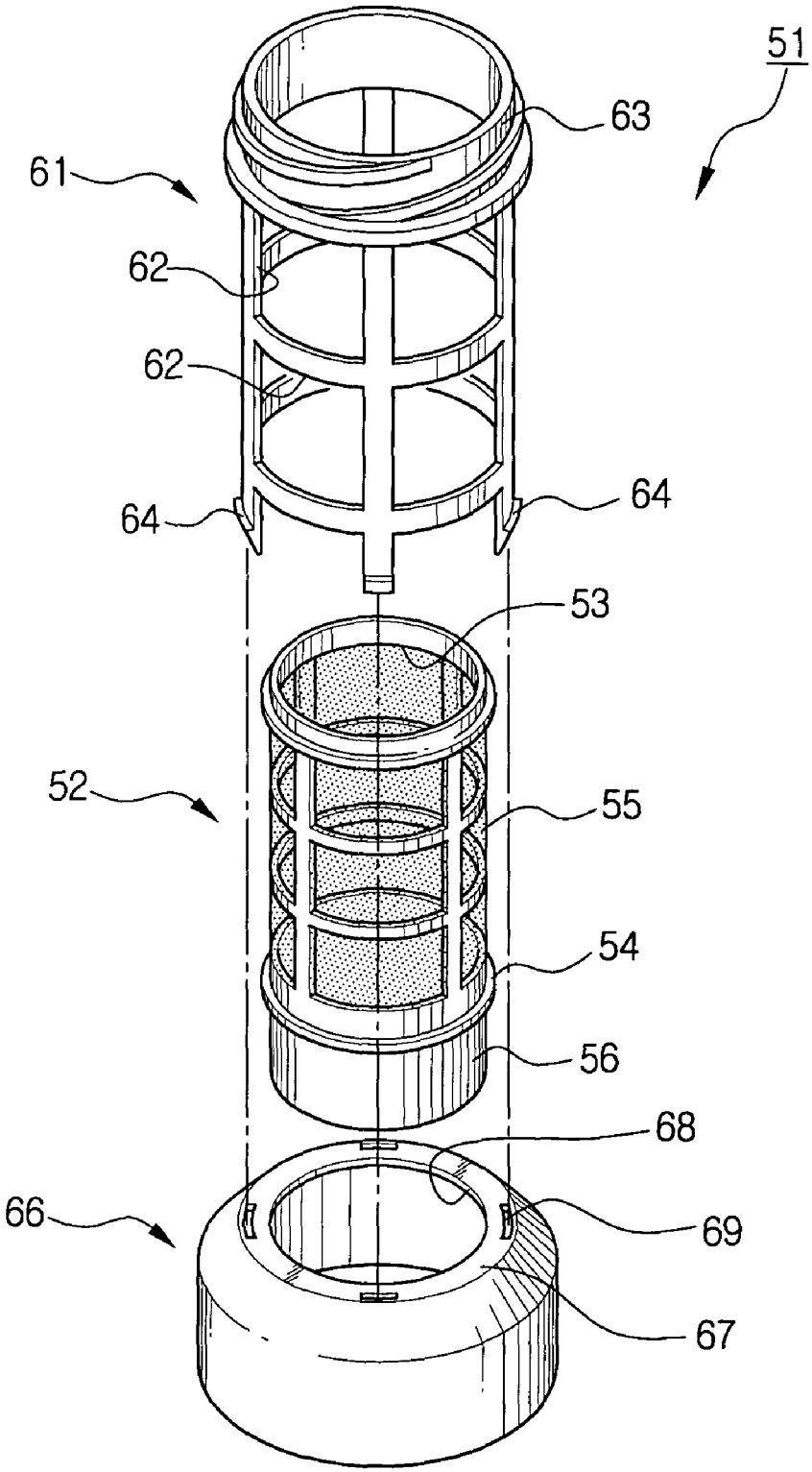
FIG. 5 is a partially enlarged view of FIG. 4 which shows the coupling structure of the rotating filter and the rotation supporting body thereof.

The rotation support body 51, as shown in more detail in FIG. 5, is comprised of a support frame 61 which receives the rotating filter 52, and a support base 66 which rotatively supports the rotating filter 52 which is coupled to the bottom of the support frame 61 and received therein. The support frame 61 is provided with numerous inlet windows 62 on the outer surface, and a coupling is provided on the top portion. On the bottom portion of the support frame 61 a plurality of hooks 64 which protrude downwardly are formed at equal spacing along the circumferential direction.

The support base 66 has a cylindrical shape opened downward, and on the upper surface there is formed a reception hole 68 which partially receives the flange 56 of the rotating filter 52. Also, on the extension of the reception hole 68, a plurality of hook holes 69 are formed to couple the hooks 64 of the support frame 61. On the upper surface 67 of the support base 66 where the hook holes 69 are formed, the rotating filter 52 is placed and rotatively supported.

On the rotation support body 51, the coupling 61 of the support frame 61 is removably coupled to the coupling flange 93 of the waste backflow prevention plate 91. Here, it is obvious that the rotation support body 51 may be embodied as a modified structure that is coupled to the outlet holes of the waste backflow prevention plate without coupling flange 93, and also as a structure directly coupled to the outlet port 23 of the upper body 21.

Meanwhile, the rotating filter 52 has an upwardly opening cylindrical shape, and an inlet grill 53 is formed on the circumferential surface. Here, the inlet grill 53 may be formed including numerous rotating filters which are able to filter minute dust within air itself. However, for a more effective filtering, it is preferred that the inlet grill 53 is simply formed of a plurality of inlet openings, and installing a net-shaped filtering member 55 on the outer surface. The upwardly opening of the rotating filter 52 forms the outlet opening in communication with the outlet port 23 and thus discharges the filtered air through the inlet grill 53.

On the bottom portion of the rotating filter 52 there is formed a downwardly extending flange 56. This flange 56 has a diameter smaller than that of the rotating filter 52, and is received and coupled into the reception hole 68 formed on the support base 66 of the rotation support body 51. Here, bottom portion of the rotating filter 52 rotationally abuts the upper surface 67 where the reception hole 68 of the support base 66 is formed. For smooth rotational coupling of the rotating filter 52, on the outer surface thereof outwardly protruding rotation protrusions 54 are formed.

Figure 6:
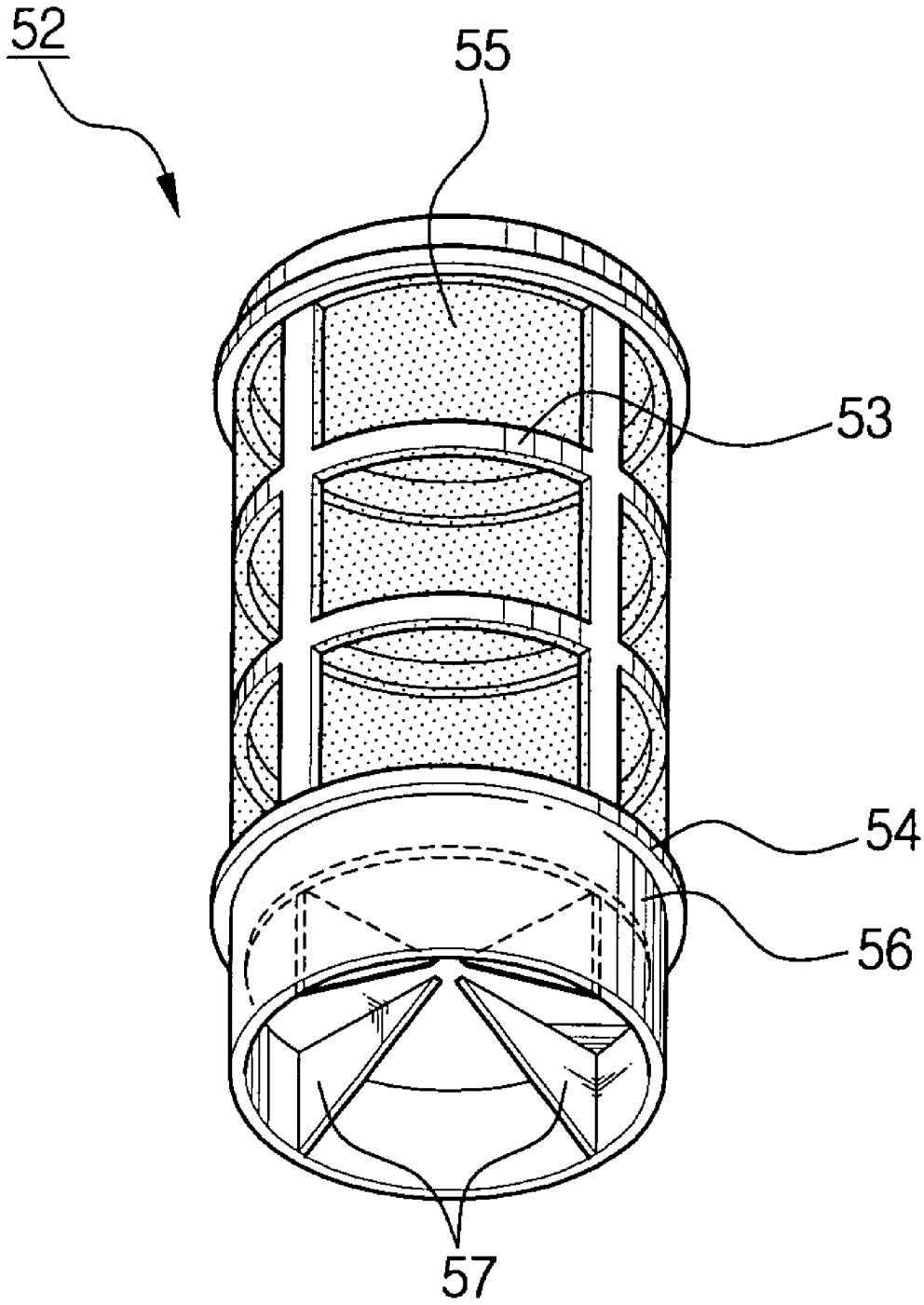
FIG. 6 is a perspective view of the lower portion of the rotating filter.

In addition, within the flange 56 of the rotating filter 52, as depicted more in detail in FIG. 6, a plurality of passive coupling protrusions 57 are formed in a radial direction protruding downward. These passive coupling protrusions 57are formed such that the respective protruding height progressively increases along the outer direction. This structure guides upward movement toward the coupling direction of the other end of the operation bar 71 to the center and thus enables precise locking of the active coupling protrusions 74 of the operation bar 71 and the passive coupling protrusions 57, as described in detail hereinafter.

This rotating filter 52 is rotatively received within the rotation support body 51 coupled to the coupling flange 93 of the waste backflow prevention plate 91. Here, the rotating filter 52 may be modified into a structure in which it is directly rotatively coupled to the waste backflow prevention plate 91 without the rotation support body 51. Also, it is obvious that the rotating filter 52 may be modified into a structure where it is rotatively coupled to the outlet port 23 of the upper body 21 not only without the rotation support body 51 but also the waste backflow prevention plate 91.

On the rotating filter 52 as such, it is preferable to install brushes 97 which remove dust collected during filtering by the filtering member 55. The brushes 97 are preferably installed between the inlet windows 63 within the support frame 61 of the rotation support body 51, and may be provided as one pair or two pairs facing each other paralleled and in the vertical direction. These brushes 67 are able to cleanly remove filtered dust within the rotation support body 61 during the rotation of the rotating filter 52.

Figure 7:
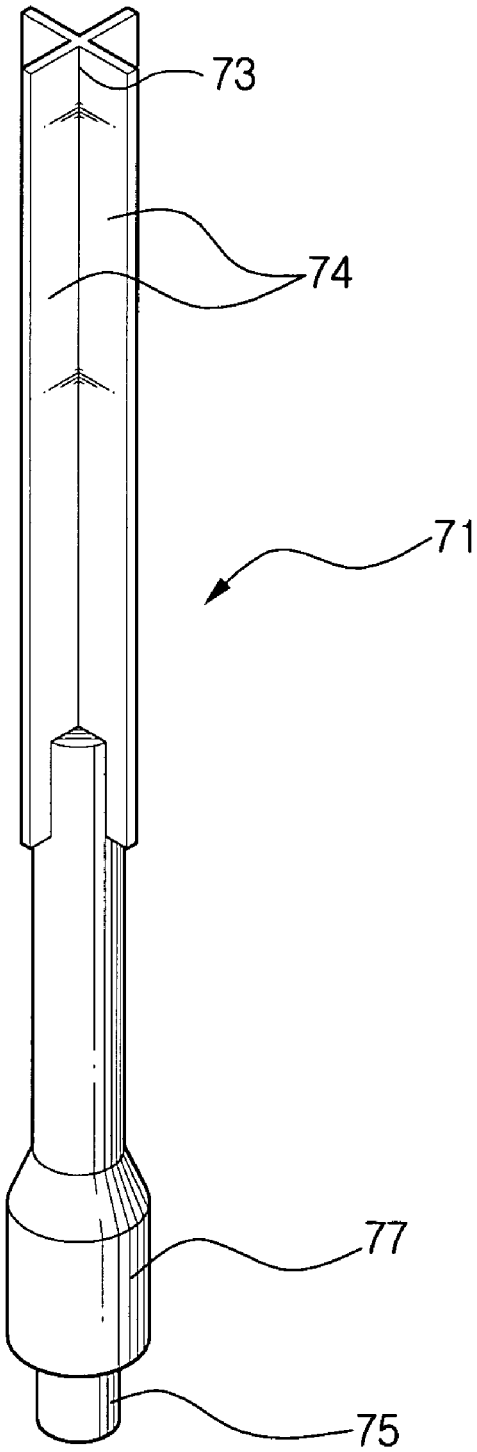
FIG. 7 is a perspective view of the operation bar of the present invention

Meanwhile, the operation bar 71, as depicted in more detail in FIG. 7, is provided with a plurality of active coupling protrusions 74 which lock with the passive coupling protrusions 57 formed on the flange 56 of the rotating filter 52. In addition, on the bottom portion, there is formed a rotational hooking portion 77 which protrudes outward and then downward to surround the circumference to the bottom end 75. This rotational hooking portion 77 is hooked with the rotation support rib 39 formed on the bottom surface of the dust collection container 31, and here the bottom end of the rotational hooking portion 77 and the upper end of the rotation support rib 39 abuts on each surface in a rotational manner. On the bottom end 75 of the operation bar 71 an assembly hole 76 is formed on the axis thereof.

The handling knob 81 is a semi-sphere shape, and is coupled to the bottom of the dust collection container 31. On the bottom surface of the handling knob 81 an upwardly protruding reception rib 83 is formed to receive the other end 75 of the operation bar 71. In the center of this reception rib 83, a passing hole is formed, and from the lower side, a screw 95 is passed through and is assembled to the assembly hole 76 of the operation bar 71 received in the reception rib 83. Through this, the handling knob 81 and the operation bar 71 may be rotated as a whole unit. On the inner circumferential area of the handling knob 81 there are formed three locking protrusion 85 which interlock with the guide protrusions 37 formed in the outer surface of the dust collection container 31.

In the cyclone-type dust collecting apparatus 1 provided with the present filter assembly 50 as the above composition, the air having waste and dust inlet into the inlet pipe 49 is inhaled through the inlet port 13 in an oblique direction. The air inhaled as such forms a swirling current by rotating about the rotating filter 52, and here the waste and dust of large particles rotating with the air is separated by centrifugal force. However, in the air with the waste and dust of large particles removed, there still exists minute dust. These minute dusts are filtered by being passed through the rotating filter 52 and then only clean air is discharged through the outlet port 23.

As time passes, the outer surface of the rotating filter 52, namely, on the filtering member 55, filtered dust is progressively collected thereon. The collected dust depreciates the speed of the air passing through the rotating filter 52 to be discharged, and thus needs to be periodically removed. Therefore, when the amount of collected dust becomes excessive, the user rotates the handling knob 81 which is coupled to the bottom portion of the dust collection container 31 to one direction. Then, the operation bar 71 coupled to the handling knob 81 rotates and turns the rotating filter 52. Here, the dust collected on the outer surface of the rotating filter 52 is separated and falls in the dust collection container 31. This dust separation is effectively carried out by the brushes 97 installed on the rotation support body 52. Here, it is preferred that the removal of the dust collected on the rotating filter 52 by rotating the handling knob 81 is occasionally carried out while conducting housework.

Meanwhile, when the waste and dust centrifugally separated and collected in the dust collection container 31 becomes excessive, the user may separate the dust collection container 31 from the cyclone body 10 and simply remove them. The dust collection container 31, as described above, is rotated to one direction and the locking protrusion 35 coupled to the coupling slit 45 is disengaged, and then may be separated by depressing downward.

Then, the dust collected in the dust collection container 31 is thrown out, and in case the dust collection container 31 is coupled back to the cyclone body 10, the upper end 73 of the operation bar 75 is guided by the passive coupling protrusions 57 formed on the flange 56 of the rotating filter 52 and moves to the center area. The passive coupling protrusions 57 of the rotating filter 52 and the active coupling protrusions 73 of the operation bar 71 are arranged such that they precisely locked. Then, the dust collection container 13 is rotated and by accommodating the locking protrusion 35 into the coupling slit 45 of the cyclone body 10, the present filter assembly 50 may be simply coupled.

As described above, according to the present invention, a filter assembly for a cyclone-type dust collecting apparatus of a vacuum cleaner in which the collected dust on the outer surface thereof may be simply removed is provided by manipulating the handling knob exposed on the bottom portion of the dust collection container and rotating the filter.

The present filter assembly for a cyclone-type dust collecting apparatus of a vacuum cleaner not only reduces manufacturing cost through a simple composition but also the assembly and disassembly thereof is facilitated, and also may be easily manufactured since the guiding groove is not required between the dust collection container and the connection pipe of the cyclone body.

What is claimed is:

1. A filter assembly for a cyclone-type dust collecting apparatus having a dust collection container of a vacuum cleaner which filters dust included in the air current discharged on the outlet port of the cyclone-type dust collecting apparatus comprising, a rotating filter rotatively coupled against said outlet port and provided with an inlet grill formed on the outer circumferential surface and an outlet in communication with said outlet port;

an operation bar arranged in the axial direction within said dust collection container and provided with one end coupled to said rotating filter and with another end passing through said dust collection container and exposed to the outside; and a handling knob coupled to said another end of said operation bar for enabling said operation bar to be rotated wholly with said rotating filter.

2. The filter assembly of claim 1, wherein the coupling of said one end of the operation bar and said rotating filter is formed of, a plurality of passive coupling protrusions protruded in the radial direction on the bottom surface of said rotating filter; and a plurality of active coupling protrusions formed to be interlocked with said passive coupling protrusions on said one end of said operation bar.

3. The filter assembly of claim 2, wherein said plurality of passive coupling protrusions are formed such that the respective protruding height thereof progressively increases along the outer direction.

4. The filter assembly of claim 1, wherein the coupling of said another end of said operation bar and said handling knob is formed of, a rotational hooking portion which extends downward from the outer circumferential surface of said operation bar to surround said another end of said operation bar, and rotatively abuts on the bottom surface of said dust collection container; and a reception rib which protrudes upward to receive said another end of said operation bar from the bottom surface of said handling knob; and an assembly member which passes through the bottom surface of said handling knob and is assembled to said another end of said operation bar.

5. The filter assembly of claim 1 further including a rotation support body which is coupled to said outlet port and rotatively supports said rotating filter.

6. The filter assembly of claim 5, wherein said rotation support body includes, a reception frame for receiving said rotating filter therein, and provided with a removable coupling for said outlet port on the upper end and a plurality of inlet windows formed on the outer circumferential surface; and a support base which is coupled to a bottom of said support frame, and rotatively supports said rotating filter.

7. The filter assembly of claim 1 further including brushes which are fixed on the outer surface of said rotating filter to remove the filtered dust on said rotating filter during the rotation of said rotating filter.

8. The filter assembly of claim 6 further including brushes which are fixed on the outer surface of said rotating filter to remove the filtered dust on said rotating filter during the rotation of said rotating filter.

* * * * *